US009766594B2

(12) United States Patent
Murdough

(10) Patent No.: US 9,766,594 B2
(45) Date of Patent: Sep. 19, 2017

(54) SCOREKEEPING DEVICE

(71) Applicant: Jody P. Murdough, Mt. Pleasant, SC (US)

(72) Inventor: Jody P. Murdough, Mt. Pleasant, SC (US)

( * ) Notice: Subject to any disclaimer, the term of this patent is extended or adjusted under 35 U.S.C. 154(b) by 146 days.

(21) Appl. No.: 14/600,329

(22) Filed: Jan. 20, 2015

(65) Prior Publication Data

US 2015/0202519 A1 Jul. 23, 2015

Related U.S. Application Data

(60) Provisional application No. 61/929,337, filed on Jan. 20, 2014.

(51) Int. Cl.

| | |
|---|---|
| ***A63B 71/06*** | (2006.01) |
| ***G04G 9/00*** | (2006.01) |
| ***G04F 10/00*** | (2006.01) |
| ***G04G 21/00*** | (2010.01) |
| ***G07C 1/22*** | (2006.01) |

(52) U.S. Cl.

CPC ..... *G04G 9/0064* (2013.01); *G04F 10/00* (2013.01); *G04G 21/00* (2013.01); *G07C 1/22* (2013.01); *A63B 71/0669* (2013.01)

(58) Field of Classification Search

CPC ..... A63B 71/06; A63B 71/066; A63F 11/00; A63F 11/0051; A63F 2011/0058; A63F 2250/495; G04F 10/00; G04G 9/00; G04G 9/0064; G04G 21/00; G06Q 10/06; G06Q 10/0639; G07C 1/22; G09F 11/00

USPC ..... 116/222; 473/221–227, 231–234

See application file for complete search history.

(56) References Cited

U.S. PATENT DOCUMENTS

| | | | |
|---|---|---|---|
| 3,822,547 | A | 7/1974 | Fujita |
| 3,936,963 | A | 2/1976 | Chan |
| 4,286,323 | A | 8/1981 | Meday |
| 4,331,098 | A | 5/1982 | Rubano |
| 4,557,215 | A | 12/1985 | Petersson |

(Continued)

FOREIGN PATENT DOCUMENTS

| | | | | |
|---|---|---|---|---|
| CH | 705580 A2 * | 4/2013 | ..... | A63B 71/0669 |
| DE | 10001296 A1 * | 7/2000 | ..... | A63B 71/06 |

(Continued)

OTHER PUBLICATIONS

ScoreBand® Operating Manual, first disclosed, offered for sale or sold to the public in Jan. 2012.

*Primary Examiner* — R. A. Smith

(74) *Attorney, Agent, or Firm* — Roger D. Emerson; Emerson, Thomson & Bennett, LLC

(57) ABSTRACT

A scorekeeping device includes: a module including: a case; a display housed inside the case and having at least first, second, and third parallel segments to show information, wherein the third segment is located between the first and the second segments; an internal circuit housed inside the case and electrically connected to the display; at least three buttons electrically connected to and configured to provide input to the internal circuit; and a battery housed inside the case and electrically connected to the internal circuit; and a band secured to the module and configured to removably secure the scorekeeping device on an associated user; wherein the internal circuit is programmed to show the information on each of the display segments.

13 Claims, 17 Drawing Sheets

(56) References Cited

U.S. PATENT DOCUMENTS

| | | | | |
|---|---|---|---|---|
| 4,769,797 | A | 9/1988 | Murakami | |
| 4,864,592 | A * | 9/1989 | Lee | A63B 71/0669 340/323 R |
| 5,124,960 | A | 6/1992 | Miller et al. | |
| 5,134,565 | A * | 7/1992 | Herbertz | G04G 9/0064 273/DIG. 26 |
| 5,550,884 | A | 8/1996 | Berney | |
| 5,730,658 | A | 3/1998 | Kurtz et al. | |
| 5,871,406 | A | 2/1999 | Worrell | |
| 6,125,081 | A * | 9/2000 | Flynn | G04G 9/0064 368/10 |
| 6,144,620 | A | 11/2000 | dePoortere | |
| 6,401,254 | B1 * | 6/2002 | Boller | A41D 19/0027 116/223 |
| 6,634,548 | B1 * | 10/2003 | Bowman | A63B 71/06 235/1 B |
| 6,646,958 | B1 | 11/2003 | Geiger | |
| 6,728,971 | B1 * | 5/2004 | Benavidez | A41D 19/0027 2/161.4 |
| 7,057,976 | B2 | 6/2006 | Berseth et al. | |
| 7,277,361 | B1 | 10/2007 | Baba | |
| 7,304,914 | B2 * | 12/2007 | Suk et al. | A63B 57/00 368/10 |
| 7,345,958 | B1 | 3/2008 | Kneafsey | |
| 7,628,315 | B2 | 12/2009 | Duncan | |
| 7,773,461 | B1 * | 8/2010 | Crosby, Sr. | A63B 71/0669 368/10 |
| 8,123,624 | B2 | 2/2012 | Caldwell | |
| 8,323,107 | B2 * | 12/2012 | Amit | A61B 5/1123 463/35 |
| 8,562,489 | B2 | 10/2013 | Burton et al. | |
| 2007/0203592 | A1 * | 8/2007 | Pennington | A63B 71/06 700/92 |
| 2011/0003665 | A1 * | 1/2011 | Burton et al. | G04F 10/00 482/9 |
| 2013/0192514 | A1 * | 8/2013 | Murdough | G09F 11/00 116/222 |
| 2014/0342851 | A1 * | 11/2014 | Jackson | A63B 69/38 473/464 |

FOREIGN PATENT DOCUMENTS

| | | | | |
|---|---|---|---|---|
| FR | 2539636 | A1 * | 7/1984 | A63B 71/06 |
| GB | 2293329 | A * | 3/1996 | A63B 71/06 |
| GB | 2314779 | A * | 1/1998 | A63B 71/06 |
| GB | 2468479 | A * | 9/2010 | A63B 71/0669 |
| JP | 2008188388 | A * | 8/2008 | A63B 71/06 |

* cited by examiner

SCOREKEEPING DEVICE

I. CROSS-REFERENCE TO RELATED APPLICATIONS

This application incorporates by reference U.S. application Ser. No. 13/534,352, filed on Jun. 27, 2012; U.S. application No. 61/929,337, filed on Jan. 20, 2014; and U.S. Patent Application Publication No. 2013/0192514, published on Aug. 1, 2013.

II. BACKGROUND

This invention pertains to the art of wearable scorekeeping devices having multiple-segment displays for showing the scores of different types of games. Various sporting or other games require keeping score and/or time. Scorekeeping options include keeping the scores in memory, writing down the scores, or using scorekeeping devices. Memorizing scores involves the risk of forgetting them. Writing down scores requires a writing instrument and medium, which must be carried by the writer; carrying such items may be inconvenient for the writer, especially if the writer is participating in the game. Some scorekeeping devices are bulky and must be carried by the user, leading to the same inconveniences as with writing down scores. Other scorekeeping devices receive and display only a limited amount of information. To address the above limitations, this scorekeeping device is disclosed.

III. SUMMARY

In accordance with one aspect of the present invention, a scorekeeping device includes: a module including: a case; a display housed inside the case and having at least first, second, and third parallel segments to show information, wherein the third segment is located between the first and the second segments; an internal circuit housed inside the case and electrically connected to the display, wherein the internal circuit includes a processor and memory; at least three buttons electrically connected to and configured to provide input to the internal circuit, wherein a first button is located next to the first segment of the display, and wherein a second button is located next to the second segment of the display; and a battery housed inside the case and electrically connected to the internal circuit; and a band secured to the module and configured to removably secure the scorekeeping device on an associated user; wherein the internal circuit is programmed to show the information on each of the display segments.

In accordance with another aspect of the present invention, a method of using a scorekeeping device includes the steps of: a) providing a user with the scorekeeping device; b) the user participating in a game or sport; and c) the user keeping track of score or time in the game or sport by operating the scorekeeping device using at least one of the six buttons.

Still other benefits and advantages of the invention will become apparent to those skilled in the art to which it pertains upon a reading and understanding of the following detailed specification.

IV. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

Figure 12:
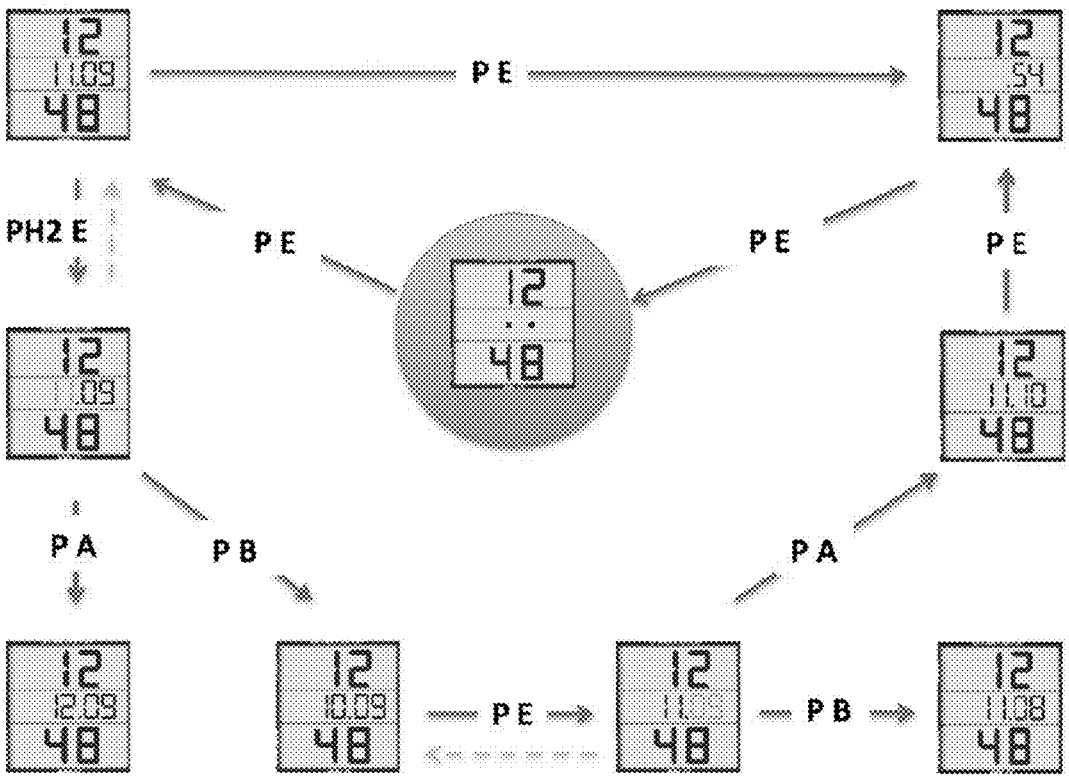

FIG. 12 also shows an algorithm in TIME mode.

Figure 13:
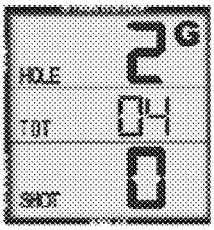

FIG. 13 is a view of the display of one embodiment of a scorekeeping device in GOLF mode.

Figure 14:
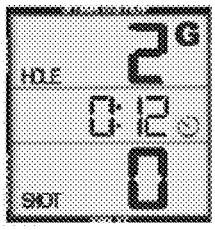

FIG. 14 is another view of the display of one embodiment of a scorekeeping device in GOLF mode.

Figure 15:
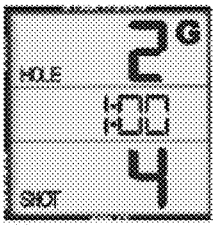

FIG. 15 is another view of the display of one embodiment of a scorekeeping device in GOLF mode.

Figure 16:
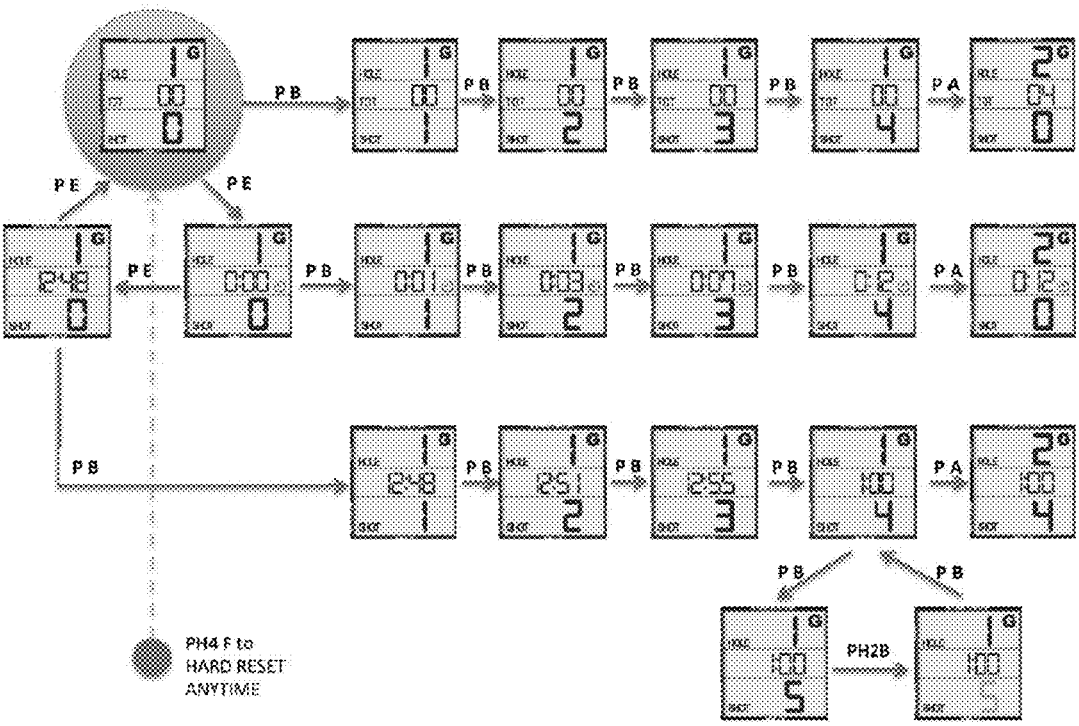

FIG. 16 shows an algorithm in GOLF mode.

Figure 17:
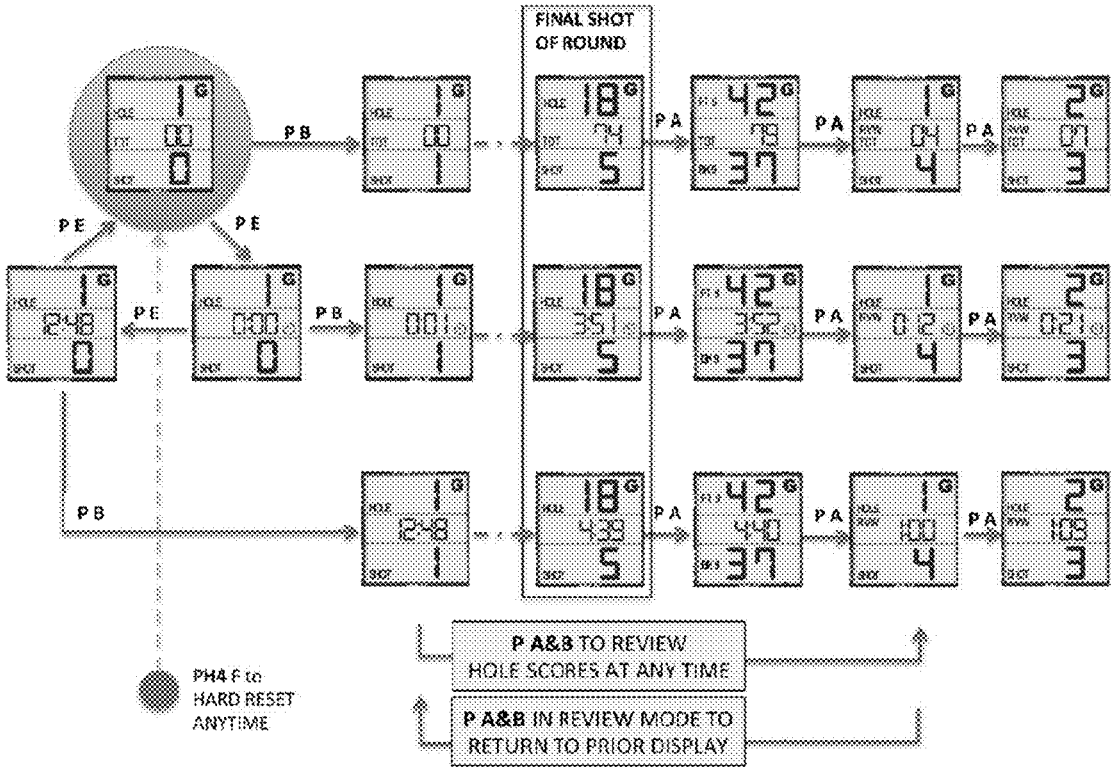

FIG. 17 also shows an algorithm in GOLF mode.

Figure 18:
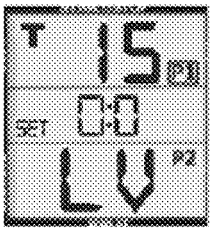

FIG. 18 is a view of the display of one embodiment of a scorekeeping device in TENNIS mode.

Figure 19:
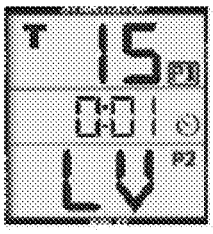

FIG. 19 is another view of the display of one embodiment of a scorekeeping device in TENNIS mode.

Figure 20:
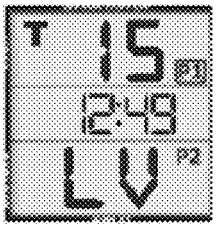

FIG. 20 is another view of the display of one embodiment of a scorekeeping device in TENNIS mode.

Figure 21:
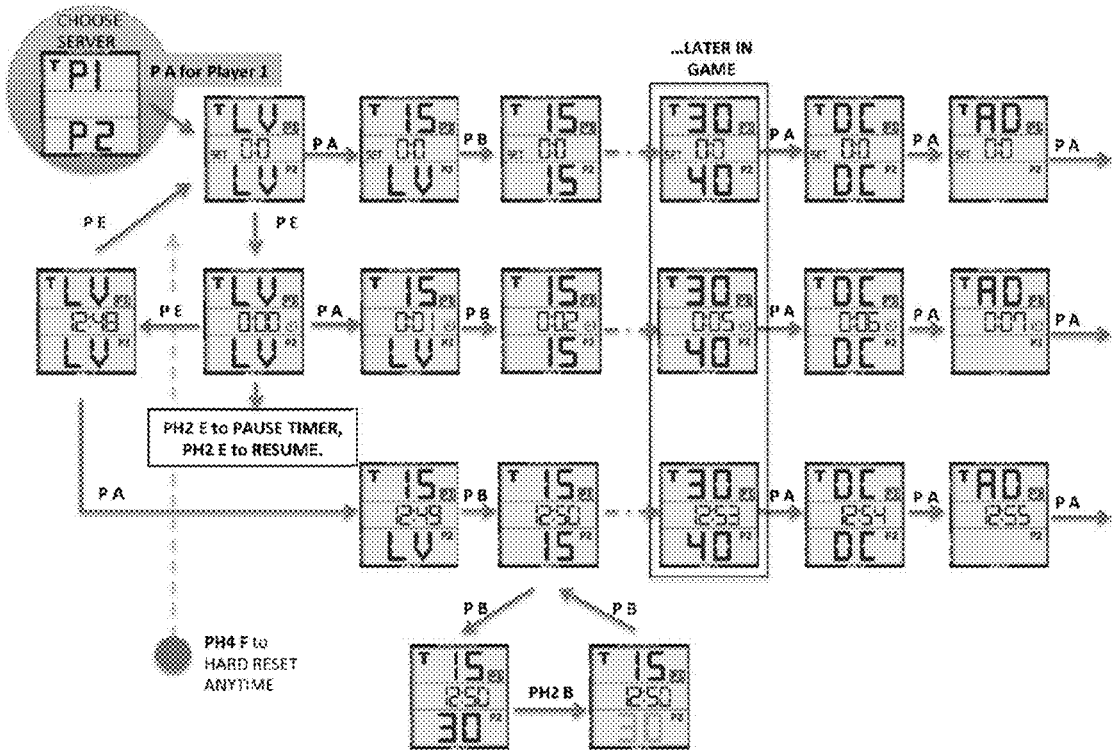

FIG. 21 shows an algorithm in TENNIS mode.

Figure 22:
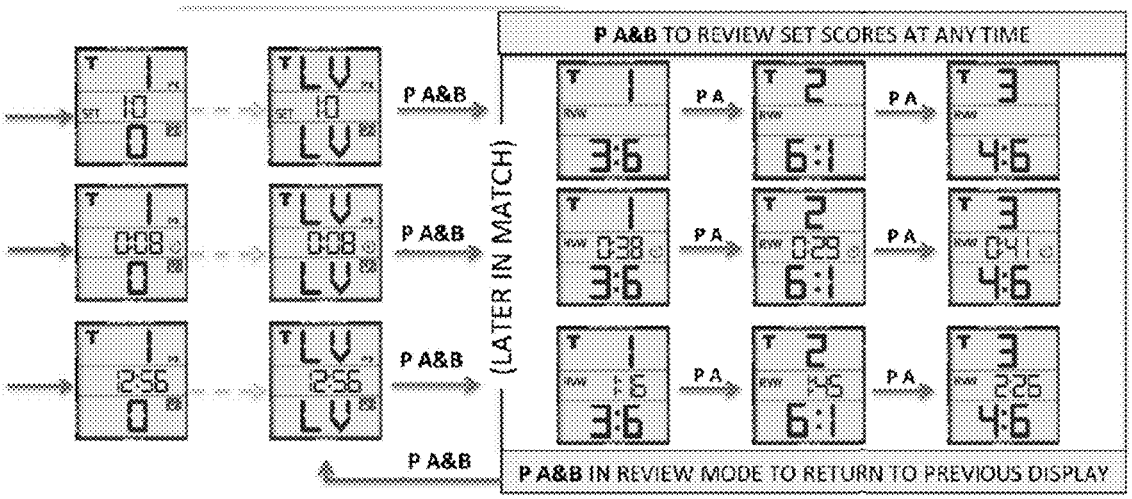

FIG. 22 also shows an algorithm in TENNIS mode.

Figure 23:
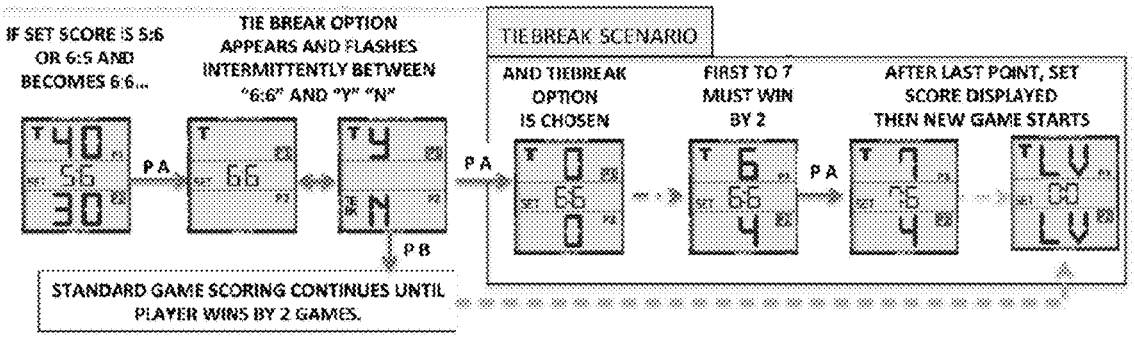

FIG. 23 also shows an algorithm in TENNIS mode.

Figure 24:
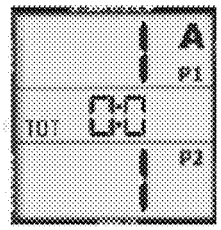

FIG. 24 is a view of the display of one embodiment of a scorekeeping device in ALLSCORE mode.

Figure 25:
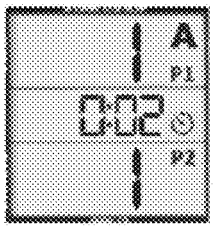

FIG. 25 is another view of the display of one embodiment of a scorekeeping device in ALLSCORE mode.

Figure 26:
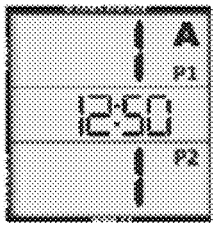

FIG. 26 is another view of the display of one embodiment of a scorekeeping device in ALLSCORE mode.

Figure 27:
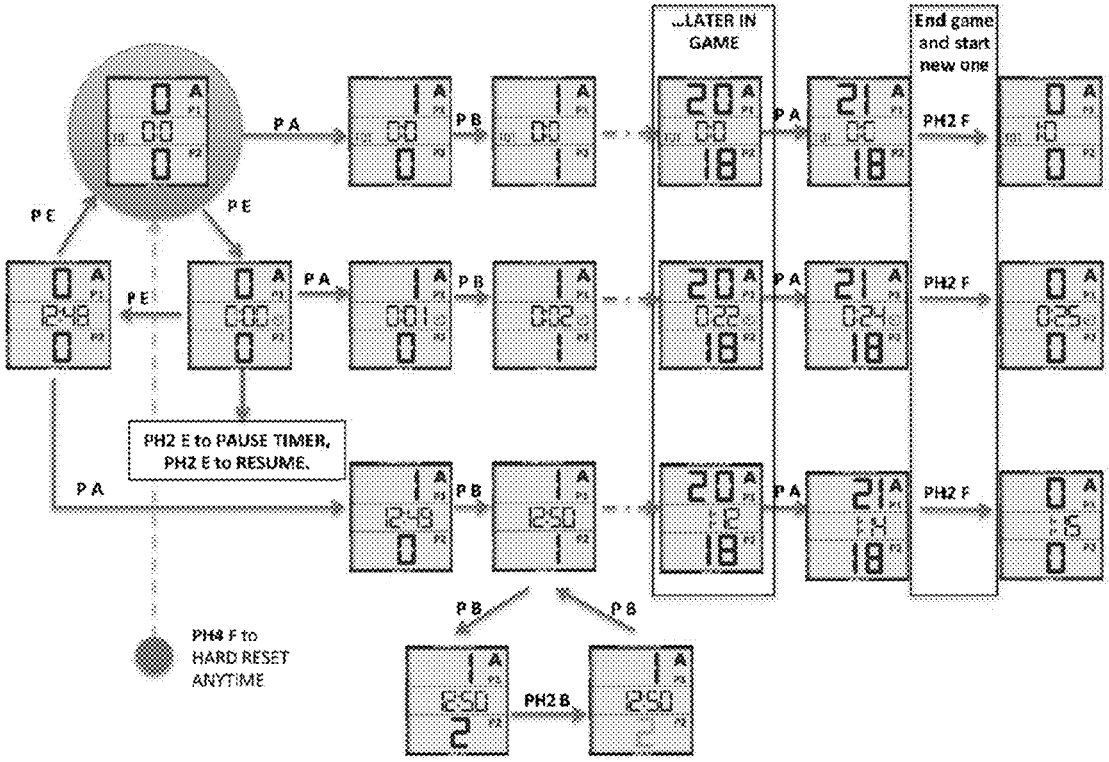

FIG. 27 shows an algorithm in ALLSCORE mode.

Figure 28:
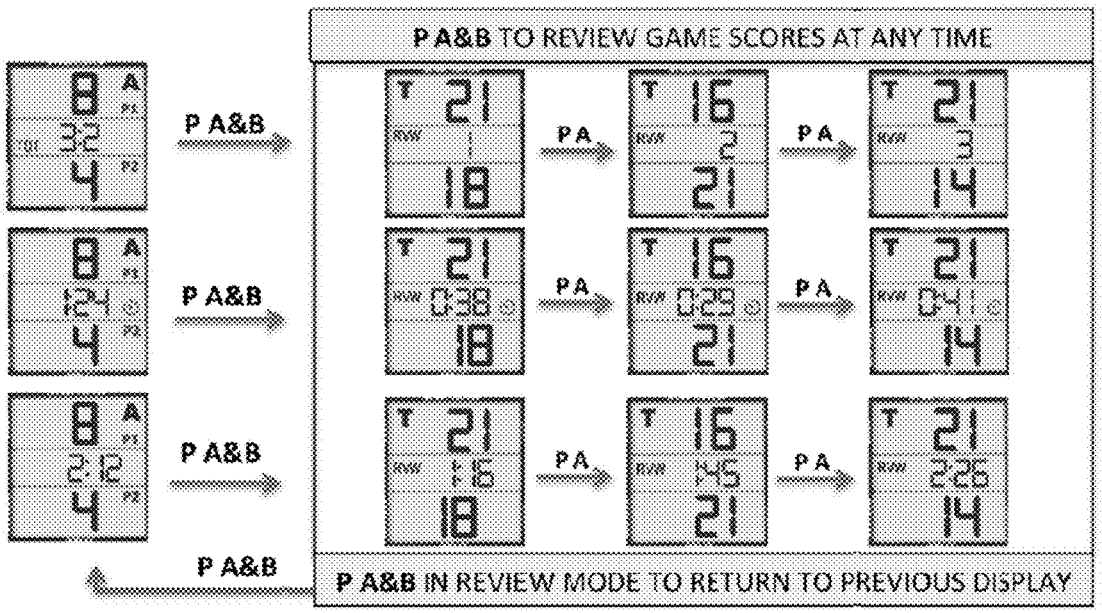

FIG. 28 also shows an algorithm in ALLSCORE mode.

Figure 29:
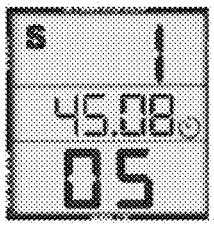

FIG. 29 is a view of the display of one embodiment of a scorekeeping device in STOPWATCH mode.

Figure 30:
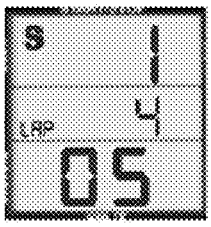

FIG. 30 is another view of the display of one embodiment of a scorekeeping device in STOPWATCH mode.

Figure 31:
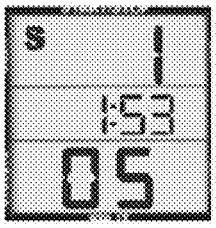

FIG. 31 is another view of the display of one embodiment of a scorekeeping device in STOPWATCH mode.

Figure 32:
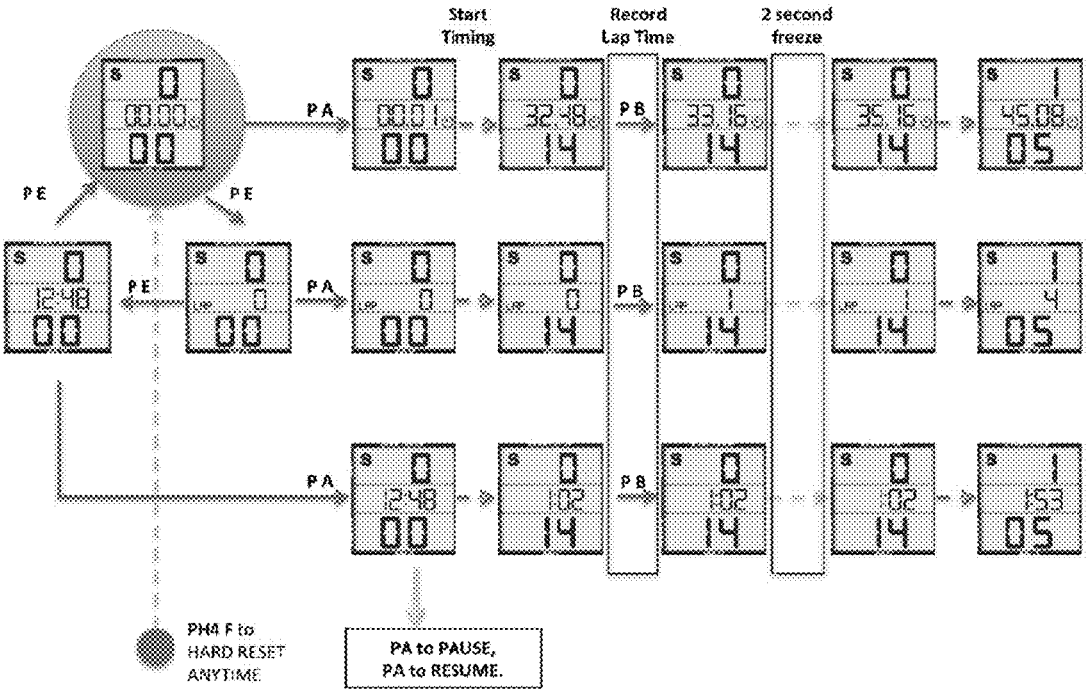

FIG. 32 shows an algorithm in STOPWATCH mode.

Figure 33:
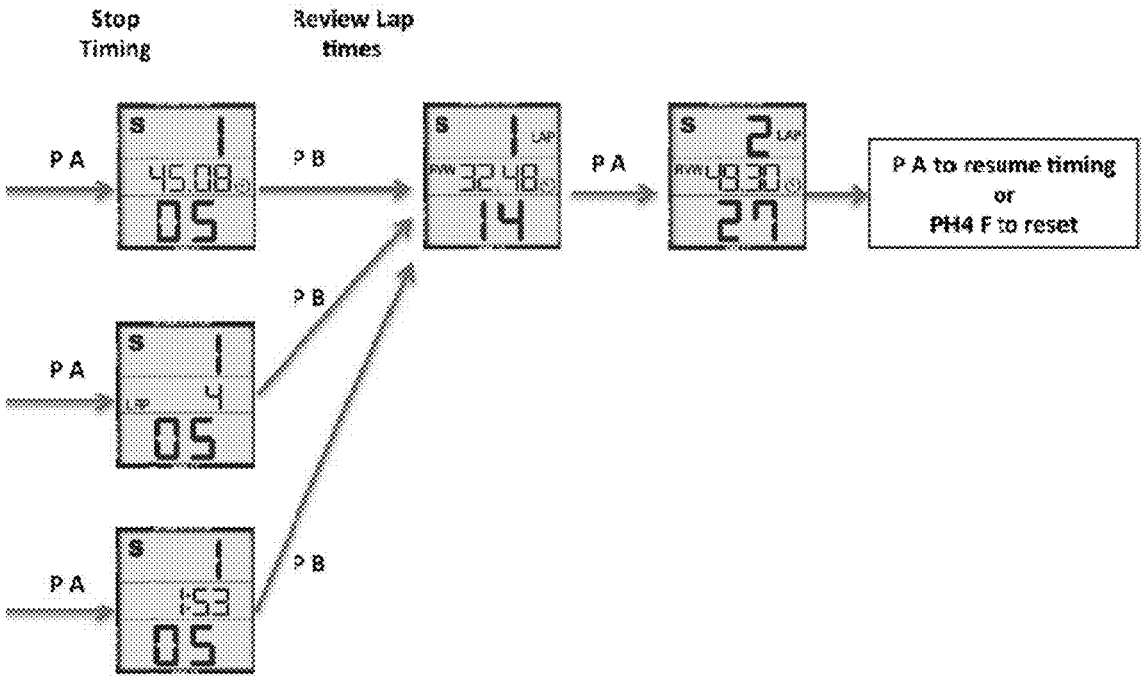

FIG. 33 also shows an algorithm in STOPWATCH mode.

V. DETAILED DESCRIPTION

Figure 1:
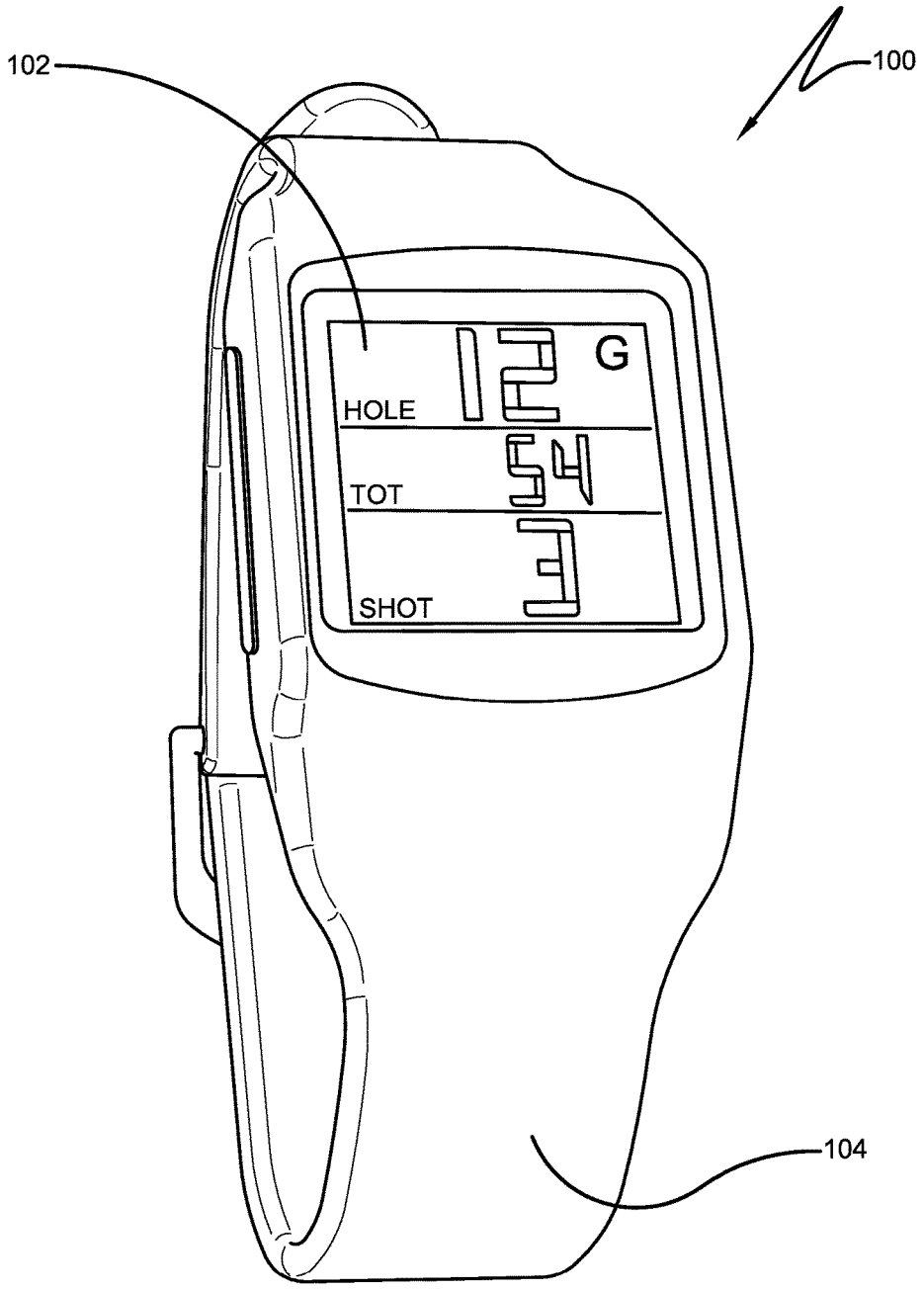
FIG. 1 is a front perspective view of one embodiment of a scorekeeping device.

Referring now to the drawings wherein the showings are for purposes of illustrating embodiments of the invention only and not for purposes of limiting the same, and wherein like reference numerals are understood to refer to like components, FIG. 1 shows a front perspective view of one embodiment of a scorekeeping device 100. In one embodiment, the device 100 may look like a watch. The device 100 may include a module with a display or screen 102 that shows information. The displayed information may be alphanumeric or graphic, and it may be shown in different colors. The device 100 may include a band 104 (which may be a pair of bands, in one embodiment) that allows the device 100 to be worn by a user. In alternative embodiments, the user may wear the device 100 on the user's wrist, on the user's arm, around the user's ankle, or on the user's leg. In alternative embodiments, the band 104 may be a polymeric band, a leather band, a cloth band, a metal band, or a band made from synthetic materials. Alternative embodiments may have the bands 104 in different colors for aesthetic purposes.

Figure 2:
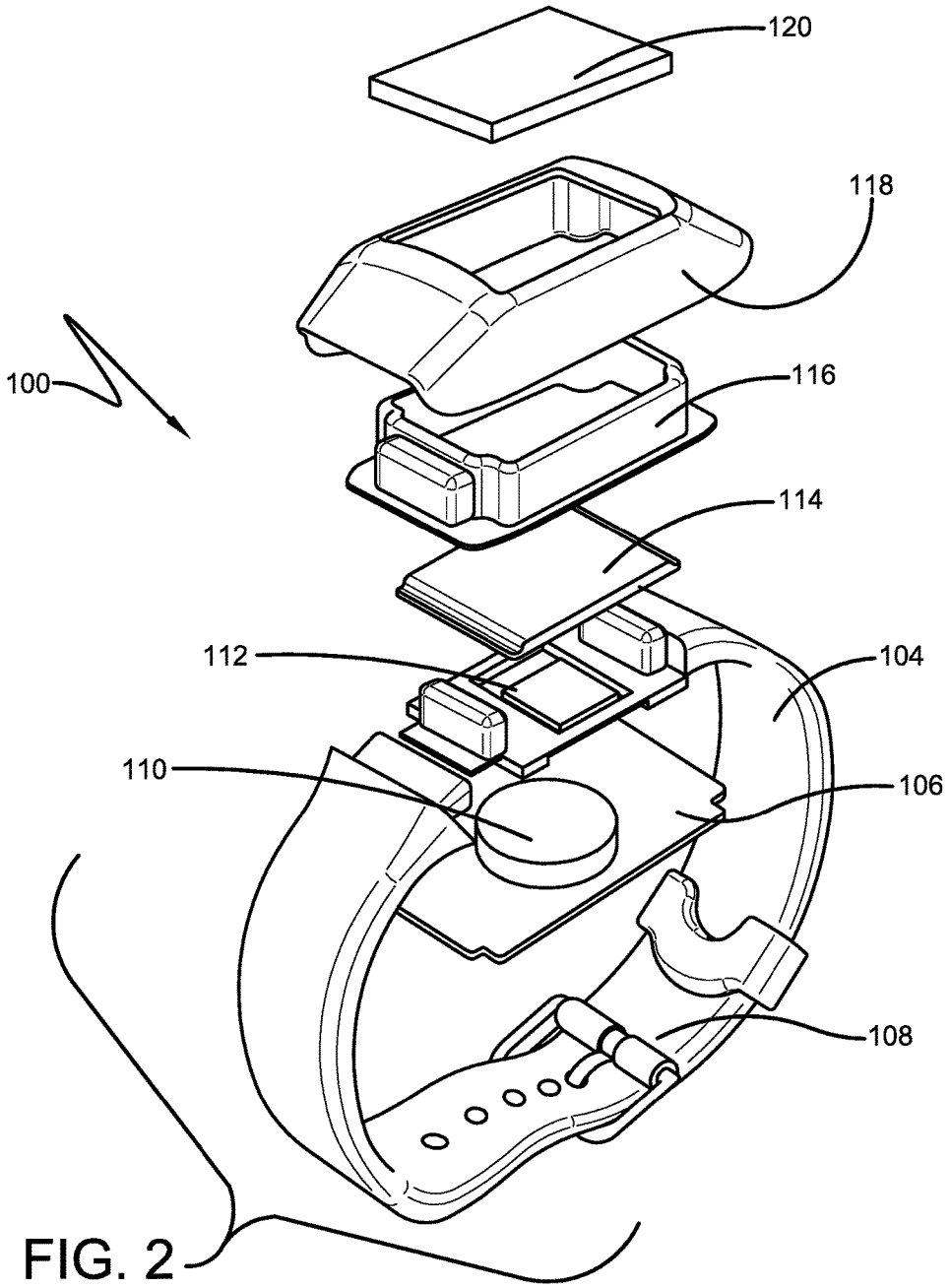
FIG. 2 is an exploded view of one embodiment of a scorekeeping device.

FIG. 2 shows an exploded view of one embodiment of a scorekeeping device 100. The band 104 of the device 100 may include a buckle 108 or clasp to allow the user to remove the device 100. An alternative embodiment of the band 104 may be an elastic band 104 that stretches to allow the user to put on or take off the device 100.

With continued reference to FIG. 2, the device 100 may also include an internal housing 116 that houses a liquid crystal display (LCD) 114 (that is a part of the display 102), an internal circuit 112 containing the software logic of the device 100, and a battery 110 for powering the device 100. In another embodiment, the display may use a light-emitting diode (LED) display instead of an LCD 114. In one embodiment, the band 104 may be connected to the housing 116. In alternative embodiments, the housing 116 may be polymeric or metallic. The device 100 may also include a case 118 that encloses the housing 116 and internal components of the device 100. In one embodiment, the housing 116 may be part of or integral to the case 118. In one embodiment, the case 118 may snap onto the housing 116. In alternative embodiments, the case 118 may be polymeric or metallic. The device 100 may also include a display cover 120 that is secured by the case 118 or housing 116 and that covers the LCD 114. In alternative embodiments, the cover 120 may be polymeric or glass. The cover 120 may be transparent to allow the user to see the information shown on the display 102 with the LCD 114. The device may also include a backplate 106 that encloses the internal components of the device 100. In alternative embodiments, the backplate 106 may be polymeric or metallic. The backplate 106 may secure the battery 110 to the internal circuit 112. In one embodiment, the backplate 106 may be secured to the housing 116, which may be by screws. In alternative embodiments, the device 100 may be water-resistant or water-proof.

With continued reference to FIG. 2, the LCD 114 may be electrically connected to the internal circuit 112, which controls the information displayed on the LCD 114. The internal circuit 112 may include circuitry that receives inputs from the device's buttons 122, 124, 126, 128, 130, 132. In an alternative embodiment, the band 104 may be physically connected to a board containing the internal circuit 112. The internal circuit 112 may include at least one processor and memory. In one embodiment, the battery 110 may be a lithium battery, may be a 3V battery, and may be a rechargeable battery. Alternative embodiments may include a wireless communication interface (such as the interface and protocol used by devices certified under the certification mark WI-FI®; the telecommunication and computer interface and protocol used by devices certified under the certification mark BLUETOOTH®; the wireless communication interface and protocol used by devices sold under the trademark ZIGBEE®; or the CDMA, TDMA, or GSM cellular interfaces) or a wired communication interface (such as a USB port).

Figure 3:
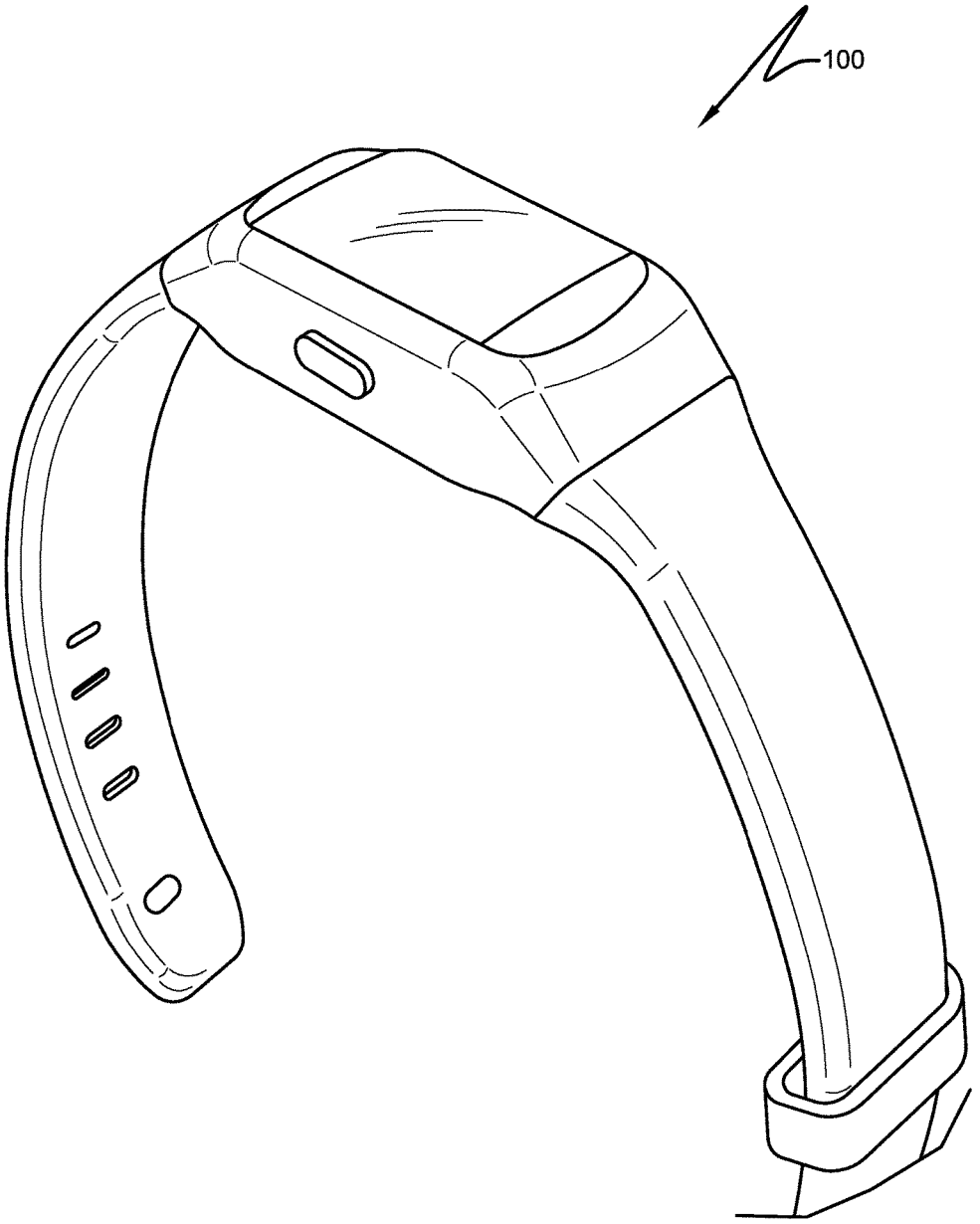
FIG. 3 is a side perspective view of one embodiment of a scorekeeping device.
Figure 4:
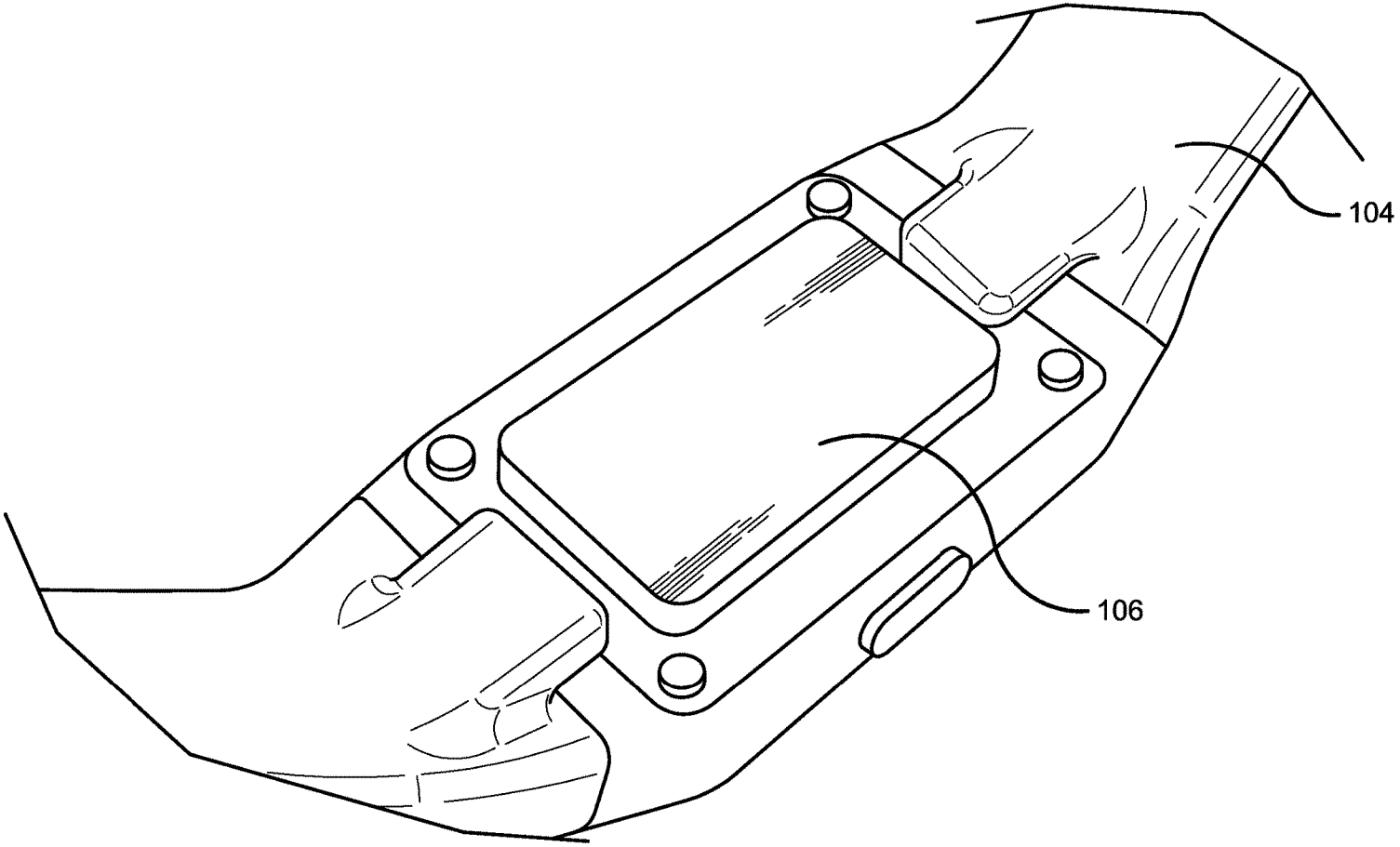
FIG. 4 is a bottom view of one embodiment of a scorekeeping device.
Figure 5:
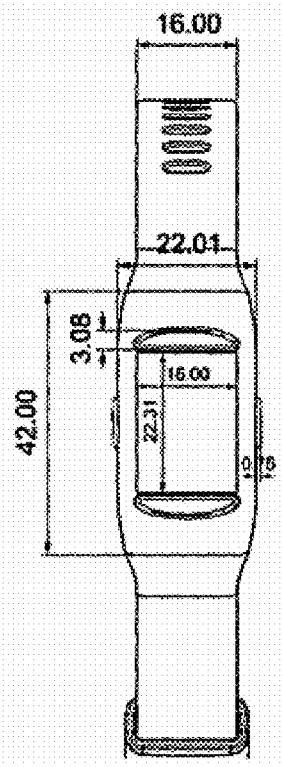
FIG. 5 is a schematic front view of one embodiment of a scorekeeping device.
Figure 6:
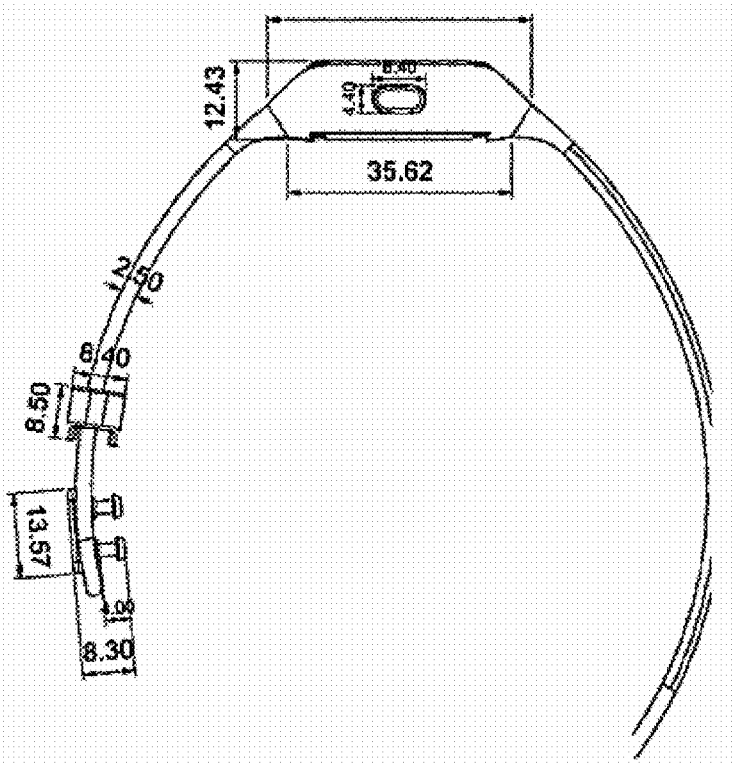
FIG. 6 is a schematic side view of one embodiment of a scorekeeping device.

FIG. 3 shows a side perspective view of an alternative embodiment of a scorekeeping device 100. In an alternative embodiment, the band may be integral to the module housing the display 102 and internal circuitry. FIG. 4 shows a bottom view of an alternative embodiment of a scorekeeping device 100. FIG. 5 shows a schematic front view of another alternative embodiment of a scorekeeping device 100, with exemplary measurements. FIG. 6 shows a schematic side view of another alternative embodiment of a scorekeeping device 100, with exemplary measurements.

Figure 7:
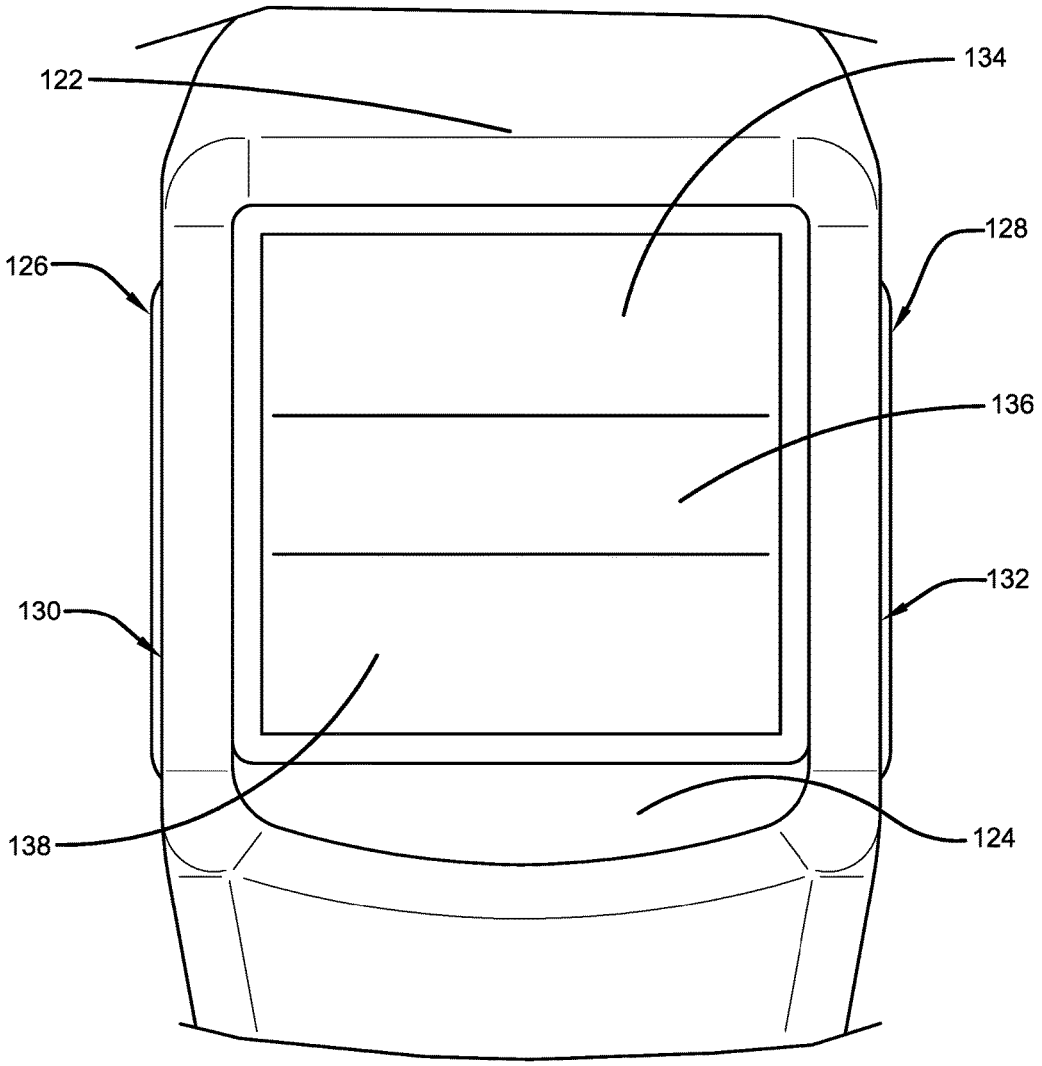
FIG. 7 is a partial front view of one embodiment of a scorekeeping device.

FIG. 7 shows a partial front view of one embodiment of a scorekeeping device 100. The device 100 may include button A 122, button B 124, button C 126, button D 128, button E 130, and button F 132. Buttons A and B 122, 124 may be positioned on the front of the device 100 above and below the display 102, respectively. Buttons C and E 126, 130 may be positioned on the left side of the device 100. Buttons D and F 128, 132 may be positioned on the right side of the device 100. These buttons may be used to control and input information into the device 100. Button A 122 may also be known as the START/STOP button. Button B 124 may also be known as the SPLIT button. Button C 126 may also be known as the MODE button. Button D 128 may also be known as the LIGHT button. Button E 130 may also be known as the DATABAR button or the button controlling the middle segment 138 of the display 102. Button F 132 may also be known as the RESET button.

With continued reference to FIG. 7, the display 102 may include at least three segments. FIG. 7 shows a top segment 134, a middle segment 136, and a bottom segment 138. These segments may display different information. The segments 134, 136, 138 may be parallel, of equal width. In one embodiment, the top segment 134 and the bottom segment 138 may be of equal height, while the middle segment 136 may be of lesser height than the top or bottom segments 134, 138. In one embodiment, the middle segment 136 may be approximately 70-75% of the height of the top or bottom segments 134, 138. In one embodiment, the middle segment 136 may be approximately 65-80% of the height of the top or bottom segments 134, 138. In another embodiment, all three segments 134, 136, 138 may be of equal height. In another embodiment, the three segments may be oriented vertically, with a left segment, a middle segment, and a right segment. In an alternative embodiment, buttons A and B 122, 124 may be located on the front of the device 100, to the left and right of the display 102, respectively. In one embodiment, the device 100 may have a backlight that illuminates the display 102 when activated. The backlight may be turned on by pressing button D 128. The backlight may then turn off when button D 128 is pressed again or when a certain amount of time (for example, 5 seconds, 10 seconds, 15 seconds, 30 seconds, or 1 minute) elapses.

The scorekeeping device 100 may have at least one mode and may have a plurality of modes. Pressing button C 126 may cycle the device 100 and its display 102 through the available modes. In one embodiment, the device 100 may have up to five modes: TIME, GOLF, TENNIS, ALLSCORE, and STOPWATCH.

Figure 8:
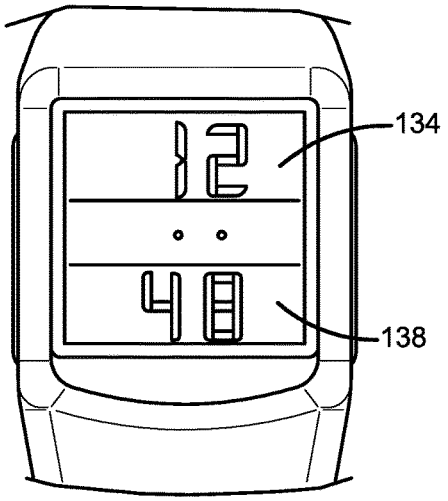
FIG. 8 is a view of the display of one embodiment of a scorekeeping device in TIME mode.
Figure 9:
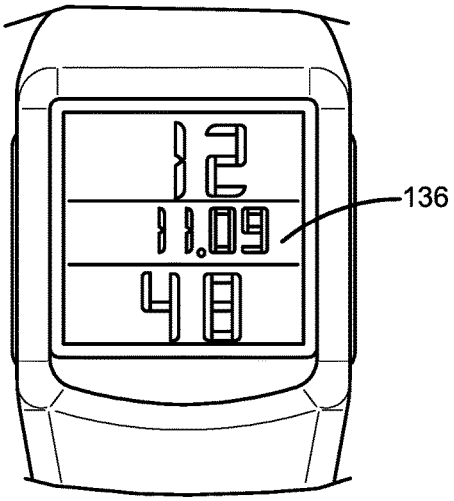
FIG. 9 is another view of the display of one embodiment of a scorekeeping device in TIME mode.
Figure 10:
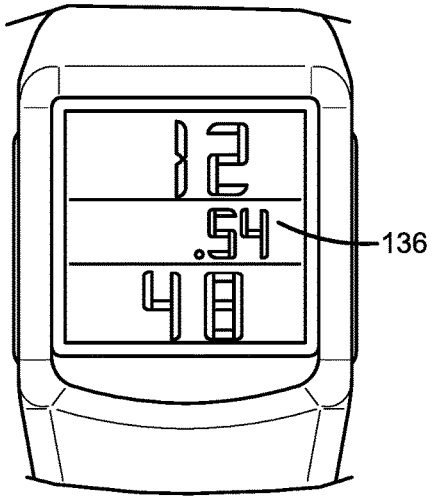
FIG. 10 is another view of the display of one embodiment of a scorekeeping device in TIME mode.

FIGS. 8-10 show a scorekeeping device 100 in TIME mode. The current hour may be displayed in the top segment 134 of the display. The current minute may be displayed in the bottom segment 138. The middle segment 136 may display the colon hour-minute separator (shown in FIG. 8), the current date (shown in FIG. 9), or the current second (shown in FIG. 10). Pressing button E 130 may cycle the middle segment 136 through the various information.

Figure 11:
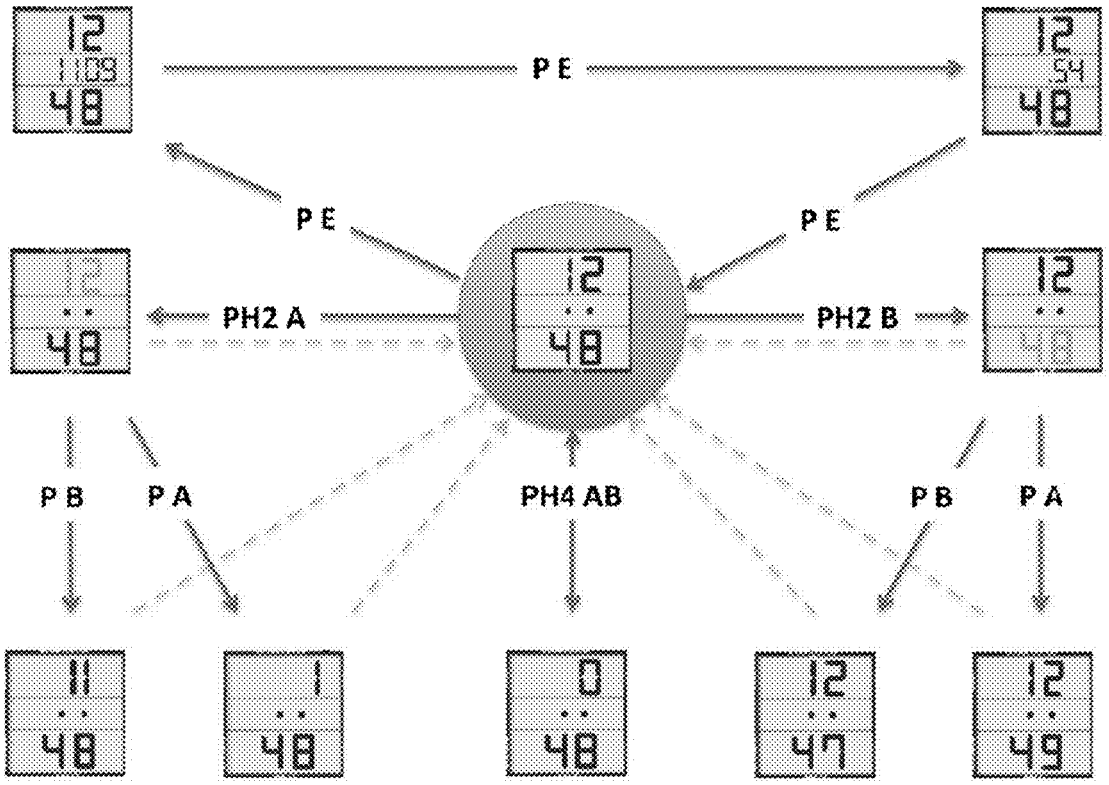
FIG. 11 shows an algorithm in TIME mode.

FIGS. 11-12 show an algorithm of one embodiment of the scorekeeping device 100 in TIME mode. In FIG. 11 (and in all subsequent algorithm figures), "P" means to press a button, "PH2" means to press and hold a button for approximately two seconds, and "PH4" means to press and hold a button for approximately four seconds. For example, "P E" means to press button E 130, and "PH4 AB" means to press and hold buttons A and B 122, 124 simultaneously for approximately four seconds. In alternative embodiments, the thresholds to hold a button to initiate action may be set at different values, such as at one second, three seconds, five seconds, or six seconds.

With continued reference to FIG. 11, to set the current hour, the user may press and hold button A 122 for approximately two seconds. To set the current minute, the user may press and hold button B 124 for approximately two seconds. The appropriate segment (top segment 134 for the hour or bottom segment 138 for the minute) may blink, allowing the user to increase or decrease the value by pressing button A 122 or button B 124, respectively. In one embodiment, with no further action (shown by the dashed lines in FIG. 11), the time will be set. In one embodiment, pressing and holding buttons A and B 122, 124 simultaneously for approximately four seconds may change the hour display from 12-hour to 24-hour.

FIG. 12 shows an algorithm to set the current date. The user may press button E 130 until the date is displayed in the middle segment 136. The user may then press and hold button E 130 for approximately two seconds, at which point the month may blink, allowing the user to increase or decrease the value by buttons A or B 122, 124, respectively. After setting the month, the user may press button E 130 to set the day in a similar manner. After setting the day, the user may press button E 130 to save the set date. The user may also wait and take no further action after setting the date to save it (which may happen after approximately five seconds of inactivity).

FIGS. 13-15 show a scorekeeping device 100 in GOLF mode. During play, the top segment 134 may show the hole number, and the bottom segment 138 may show the stroke or shot number at that hole. The middle segment 136 may display the total score of the round so far (shown in FIG. 13), the time elapsed since the start of the round (shown in FIG. 14), or the current time (shown in FIG. 15). Pressing button E 130 may cycle the middle segment 136 through the various information.

FIGS. 16-17 show an algorithm of one embodiment of the scorekeeping device 100 in GOLF mode. The user may press button B 124 to add a stroke. The round timer may start when the user initiates the first stroke of the round and may run for the duration of the entire round. The user may press button A 122 to advance to the next hole. If the user mistakenly added a stroke, the user may press and hold button B 124 for approximately two seconds, at which point the stroke number may blink, and the user may then decrease the stroke value by pressing button B 124. Pressing and holding button F 132 for approximately four seconds may reset the device 100 to the beginning of a new round.

Once the round is finished, the device 100 may show the statistics of that round in a review mode. As shown in FIG. 17, once the user enters the final stroke on the $18^{th}$ hole and presses button A 122, the round is finished, and the round timer may stop running. In review mode, the top segment 134 may display the score for the front nine holes, the bottom segment 138 may display the score for the back nine holes, and the middle segment 136 may display the total round score, the total round time, or the current time. The user may review the statistics of each hole by pressing button A 122, which will cycle through each hole with each press of button A 122. The top segment 134 may show the hole number, the bottom segment 134 may show the number of shots or strokes at that hole, and the middle segment 136 may show the total round score through that hole, the round time elapsed through that hole, or the actual time at the end of that hole. While the user is playing, the user may simultaneously press buttons A and B 122, 124 to enter review mode to review the statistical information of the holes so far, in one embodiment. The user may exit review mode and return to play mode by again simultaneously pressing buttons A and B 122, 124.

FIGS. 18-20 show a scorekeeping device 100 in TENNIS mode. During play, the top segment 134 may show the first player's score, and the bottom segment 138 may show the second player's score. An outline may appear around "P1" in the top segment 134 or around "P2" in the bottom segment 138 to indicate which player is serving. The middle segment 136 may display the set score so far (shown in FIG. 18), the time elapsed since the start of the match (shown in FIG. 19), or the current time (shown in FIG. 20). Pressing button E 130 may cycle the middle segment 136 through the various information.

FIGS. 21-23 show an algorithm of one embodiment of the scorekeeping device 100 in TENNIS mode. With reference to FIG. 21, when starting a new match, the display 102 may show "P1" and "P2"; the user may press button A 122 to select player 1 as the first to serve or button B 124 to select player 2 as the first to serve. The user may press button A 122 to add a point to player 1 and button B 124 to add a point to player 2. The points may display as "LV," "15," "30," "40," "DC," or "AD." With reference to FIG. 22, which continues the algorithm started in FIG. 21, after the final point of each game has been entered, the set score may update and display for a certain time before resuming a new game and resetting the player scores to "LV." In alternative embodiments, this certain time may be approximately 4 seconds, 5 seconds, 10 seconds, or 15 seconds.

With continued reference to FIG. 21, the match timer may start when the user initiates the first point entry and may run for the duration of the entire match. In one embodiment, the user may press and hold button E 130 for approximately two seconds while the middle segment 136 displays the match time to pause the timer. The user may again press and hold button E 130 for approximately two seconds while the middle segment 136 displays the match time to resume the timer. If the user mistakenly added a point, the user may press and hold button A 122 or button B 124 (depending on whether the mistaken point was added for player 1 or player 2, respectively) for approximately two seconds, at which point the point value may blink, and the user may then decrease the point value by pressing button B 124 or increase the point value by pressing button A 122. Pressing and holding button F 132 for approximately four seconds may reset the device 100 to the beginning of a new round.

FIG. 23 shows the algorithm when one embodiment of the scorekeeping device 100 is in "tie break" mode. If the set score reaches 6:6, in one embodiment the display 102 may ask whether the user wants to use "tie break" ("TIE BK") scoring. If the user presses button B 124 ("N" or no), the standard game scoring may continue until one player wins by two games. If the user presses button A 122 ("Y" or yes), the device may use "tie break" scoring, where points are scored in single digits, and where the first person to score seven points wins (if wins by two points).

Once the match is finished or at any time during the game, the device 100 may show the statistics of that match in a review mode. As shown in FIG. 22, once the user simultaneously presses button A 122 and button B 124, the device 100 may enter review mode. In review mode, the top segment 134 may display the set number, the bottom segment 138 may display the score for that set, and the middle segment 136 may display the match time elapsed through that set or the actual time at the end of that set. The user may cycle through each set by pressing button A 122. The user may exit review mode and return to play mode by again simultaneously pressing buttons A and B 122, 124.

FIGS. 24-26 show a scorekeeping device 100 in ALLSCORE mode. During play, the top segment 134 may show the first player's score, and the bottom segment 138 may show the second player's score. The middle segment 136 may display the games score or series score (e.g., how many games has each player or team won) so far (shown in FIG. 24), the time elapsed since the start of the game (shown in FIG. 25), or the current time (shown in FIG. 26). Pressing button E 130 may cycle the middle segment 136 through the various information.

FIGS. 27-28 show an algorithm of one embodiment of the scorekeeping device 100 in ALLSCORE mode. With reference to FIG. 27, the user may press button A 122 to add a point to player 1 and button B 124 to add a point to player 2. While this discussion refers to players, it is also applicable to teams. The ALLSCORE mode may be used with any game or sport having two players or teams and counting score numerically, such as, but not limited to, basketball, volleyball, soccer, hockey, football, baseball. The ALLSCORE mode also may be used with non-sport games. The points may numerically increment by one. After the last point for the game has been won, the user may press and hold button F 132 for approximately two seconds to end the current game and start a new one. In such a case, the games score is updated, and the score of the current individual game and the game timer are reset for the next game.

With continued reference to FIG. 27, the game timer may start when the user initiates the first point entry and may run for the duration of the entire game. In one embodiment, the user may press and hold button E 130 for approximately two seconds while the middle segment 136 displays the game time to pause the timer. The user may again press and hold button E 130 for approximately two seconds while the middle segment 136 displays the game time to resume the timer. If the user mistakenly added a point, the user may press and hold button A 122 or button B 124 (depending on whether the mistaken point was added for player 1 or player 2, respectively) for approximately two seconds, at which point the point value may blink, and the user may then decrease the point value by pressing button B 124 or increase the point value by pressing button A 122. Pressing and holding button F 132 for approximately four seconds may reset the device 100 and clear all scores and timers.

Once a games are finished or at any time during the games, the device 100 may show the statistics of those games or that series in a review mode. As shown in FIG. 28, once the user simultaneously presses button A 122 and button B 124, the device 100 may enter review mode. In review mode, the middle segment 136 may display the number of the game being reviewed, the top segment 134 may display the first player's score in that game, and the bottom segment 138 may display the second player's score in that game. The middle segment 136 may be toggled (by pressing button E 130) to display the time taken to play that game or the actual time at the end of that game. The user may cycle through each game by pressing button A 122. The user may exit review mode and return to play mode by again simultaneously pressing buttons A and B 122, 124.

FIGS. 29-31 show a scorekeeping device 100 in STOPWATCH mode. During timing, the top segment 134 may show the elapsed hours, and the bottom segment 138 may show the elapsed minutes. The middle segment 136 may display the elapsed seconds and the elapsed hundredths of a second (shown in FIG. 29 as separated by a period), the lap number (shown in FIG. 30), or the current time (shown in FIG. 31). Pressing button E 130 may cycle the middle segment 136 through the various information.

FIGS. 32-33 show an algorithm of one embodiment of the scorekeeping device 100 in STOPWATCH mode. With reference to FIG. 32, the user may press button A 122 to start, pause, resume, and stop the stopwatch. The user may press button B 124 while the stopwatch is running to record a lap and start a new one. In one embodiment, when the user records a lap, the device 100 may freeze the display 102 and show for a certain time the information that was displayed when the user recorded a lap. In alternative embodiments, the certain time may be approximately 2 seconds, 5 seconds, 10 seconds, or 15 seconds. After the certain time expires, the display 102 may continue to show the actual elapsed time in the current lap. In one embodiment, the maximum allowable lap time may be 59 minutes and 59.99 seconds.

FIG. 33, which continues the algorithm started in FIG. 32, shows the operation of the device in STOPWATCH review mode. When the stopwatch is stopped, the user may press button B 124 to enter review mode where the device 100 may show the statistics of counted laps. In review mode, the top segment 134 may display the lap number, the bottom segment 138 may display the minutes of that lap, and the middle segment 136 may display the seconds and hundredths of a second of that lap. The user may cycle through each lap by pressing button A 122. The user may exit review mode and return to timing mode by again pressing button A 122 after the last counted lap was shown (at which point the user may again press button A 122 to resume timing). Pressing and holding button F 132 for approximately four seconds may reset the device 100 and clear all timers.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A scorekeeping device comprising:

a module comprising:

a case;

a display housed inside the case and having at least first, second, and third parallel segments to show information, wherein the third segment is located between the first and the second segments;

an internal circuit housed inside the case and electrically connected to the display, wherein the internal circuit comprises:

a processor; and memory;

at least three buttons electrically connected to and configured to provide input to the internal circuit, wherein a first button is located next to the first segment of the display, and wherein a second button is located next to the second segment of the display; and a battery housed inside the case and electrically connected to the internal circuit; and a band secured to the module and configured to removably secure the scorekeeping device on an associated user;

wherein the internal circuit is programmed to show the information on each of the display segments, wherein the at least first, second, and third parallel segments are oriented horizontally and have equal width; the first and the second segments have equal height; the third segment has a height approximately 65-80% of the height of the first segment; the first segment is above the third segment; the third segment is above the second segment; the first button is located above the first segment; and the second button is located below the second segment, wherein the third segment has a height approximately 70-75% of the height of the first segment, wherein the at least three buttons comprise six buttons; the third and fourth buttons are located on the left side of the case; and the fifth and sixth buttons are located on the right side of the case, wherein the display comprises a backlight that is controlled by one of the six buttons, wherein the internal circuit is further programmed to operate in at least one mode selected from the group consisting of:

time mode;

golf mode;

tennis mode;

allscore mode; and stopwatch mode, wherein the internal circuit is further programmed to operate in time mode, golf mode, tennis mode, allscore mode, and stopwatch mode; and one of the six buttons controls the mode in which the scorekeeping device operates, and wherein the internal circuit is further programmed such that in time mode:

the first segment shows a current hour;

the second segment shows a current minute; and the third segment shows:

a current second;

a current date; or a symbol;

wherein one of the six buttons controls what information is shown on the third segment.

2. The scorekeeping device of claim 1, wherein the internal circuit is further programmed such that in golf mode:

the first segment shows a number of a hole;

the second segment shows a number of strokes taken at that hole; and the third segment shows:

a total score thus far;

time elapsed since a golf round started; or a current time;

wherein one of the six buttons controls what information is shown on the third segment;

wherein the first button increments the hole number being played; and wherein the second button increments the number of strokes taken at the hole being played.

3. The scorekeeping device of claim 2, wherein the internal circuit is further programmed to show a summary of the golf round after the round is completed, in golf mode, wherein:

the first segment shows a score for a front nine holes;

the second segment shows a score for a back nine holes; and the third segment shows:

a total score of the round;

a total round time; or the current time;

wherein one of the six buttons controls what information is shown on the third segment.

4. The scorekeeping device of claim 3, wherein the internal circuit is further programmed such that in tennis mode:

the first segment shows a game score of a first player;

the second segment shows a game score of a second player; and the third segment shows:

a set score;

time elapsed since a tennis match started; or the current time;

wherein one of the six buttons controls what information is shown on the third segment;

wherein the first button increments the game score of the first player; and wherein the second button increments the game score of the second player.

5. The scorekeeping device of claim 4, wherein the internal circuit is further programmed to display the scores in tennis mode using tennis terminology or its abbreviations.

6. The scorekeeping device of claim 5, wherein the internal circuit is further programmed to show a review of the tennis match after the match is completed, in tennis mode, wherein:

the first segment shows a set number;

the second segment shows a score for that set; and the third segment shows:

time elapsed through that set; or an actual time at an end of that set;

wherein one of the six buttons controls what information is shown on the third segment.

7. The scorekeeping device of claim 6, wherein the internal circuit is further programmed to operate in "tie break" mode, in tennis mode, if the set score reaches 6:6.

8. The scorekeeping device of claim 7, wherein the internal circuit is further programmed such that in allscore mode:

the first segment shows a score of a first player;

the second segment shows a score of a second player; and the third segment shows:

a series score thus far;

time elapsed since a game started; or the current time;

wherein one of the six buttons controls what information is shown on the third segment;

wherein the first button increments the score of the first player; and wherein the second button increments the score of the second player.

9. The scorekeeping device of claim 8, wherein the internal circuit is further programmed to show a review of the series after the series is completed, in allscore mode, wherein:

the first segment shows the score of the first player in a game in that series;

the second segment shows the score of the second player in the game in that series; and the third segment shows:

a number of the game for which the scores are shown in the first and second segments;

time taken to play that game; or an actual time at an end of that game;

wherein one of the six buttons controls what information is shown on the third segment.

10. The scorekeeping device of claim 9, wherein the internal circuit is further programmed to function as a stopwatch, in stopwatch mode, such that:

the first segment shows elapsed hours since a start of the stopwatch;

the second segment shows elapsed minutes since the start of the stopwatch; and the third segment shows:

elapsed seconds and hundredths of a second since the start of the stopwatch;

a lap number; or the current time;

wherein one of the six buttons controls what information is shown on the third segment;

wherein one of the first and second buttons starts, stops, pauses, or resumes the stopwatch; and wherein another of the first and second buttons records a lap and starts a new lap.

11. The scorekeeping device of claim 10, wherein the internal circuit is further programmed to show a review of the laps, in stopwatch mode, wherein:

the first segment shows the lap number;

the second segment shows minutes of that lap; and the third segment shows seconds and hundredths of a second of that lap;

wherein one of the six buttons cycles through the recorded laps.

12. The scorekeeping device of claim 11, wherein one of the six buttons resets:

1) the scores saved in golf mode, tennis mode, and allscore mode, and 2) the timers started in golf mode, tennis mode, all score mode, and stopwatch mode.

13. A method of using a scorekeeping device, comprising the steps of:

a) providing a user with the scorekeeping device of claim 1;

b) the user participating in a game or sport; and c) the user keeping track of score or time in the game or sport by operating the scorekeeping device using at least one of the six buttons.

* * * * *